United States Patent [19]

Ricles et al.

[11] Patent Number: 5,007,344

[45] Date of Patent: Apr. 16, 1991

[54] DUAL FIRING SYSTEM FOR A PERFORATING GUN

[75] Inventors: Thomas D. Ricles, Kingwood; Richard M. Ward, Laporte, both of Tex.

[73] Assignee: Dresser Industries, Inc., Dallas, Tex.

[21] Appl. No.: 278,659

[22] Filed: Dec. 1, 1988

[51] Int. Cl.[5] ..... F42B 3/00; E21B 7/00

[52] U.S. Cl. ..... 102/31.2; 102/313; 175/4.55; 175/4.56

[58] Field of Search ..... 102/312, 313, 320; 175/4.55, 4.56

[56] References Cited

U.S. PATENT DOCUMENTS

| | | | |
|---|---|---|---|
| 2,540,184 | 2/1951 | Broyles | 175/4.55 |
| 3,612,189 | 10/1971 | Brooks et al. | 175/4.55 X |
| 3,923,105 | 12/1975 | Lands, Jr. | 175/4.55 |
| 3,923,106 | 12/1975 | Bosse-Platiere | 175/4.55 |
| 4,011,815 | 3/1977 | Garcia | 175/4.55 X |
| 4,164,886 | 8/1979 | Hallmark | 175/4.55 X |
| 4,484,639 | 11/1984 | Ayers | 175/4.56 |
| 4,491,185 | 1/1985 | McClure | 175/4.56 |
| 4,610,312 | 9/1986 | Nelson et al. | 175/4.52 |
| 4,616,701 | 10/1986 | Stout et al. | 166/551 |
| 4,619,333 | 10/1986 | George | 175/4.52 |
| 4,629,009 | 12/1986 | Whiting et al. | 175/4.56 |
| 4,632,034 | 12/1986 | Colle, Jr. | 102/312 |
| 4,650,009 | 3/1987 | McClure et al. | 175/4.6 |
| 4,678,044 | 7/1987 | Luke et al. | 175/4.52 |
| 4,770,246 | 9/1988 | Ward | 166/297 |

FOREIGN PATENT DOCUMENTS 288237 10/1988 European Pat. Off. .

OTHER PUBLICATIONS

Technical Brochures; "Tubing-Conveyed Perforating System", Dresser Atlas, Apr., 1983.

Dresser Atlas Services Catalog, Aug., 1984.

"Shots Heard Around the World", Baker Perforating Systems, undated.

*Primary Examiner*—Peter A. Nelson

[57] ABSTRACT

A unitary dual firing assembly includes a high explosive detonation cord with ends, each actuable by a different firing mechanism. The ends of the high explosive detonation cord are adjacent respective bulkhead membranes which, if broken, are effective to transfer a shockwave to detonate the high explosive cord. An intermediate section of the high explosive cord is effective to detonate perforating gun apparatus. A hydraulic firing head is located adjacent the membrane at one end of the high explosive detonating cord, while a mild explosive detonating cord is located adjacent the membrane at the other end of the high explosive detonating cord. An upper end of the mild explosive detonating cord terminates in a stem cap assembly which is responsive to an impact for detonating the high explosive cord, via a lower end of the mild explosive detonating cord. Mechanical or fluid inputs can thus be applied to reliably detonate one or the other of the firing mechanisms to trigger the perforating gun.

26 Claims, 4 Drawing Sheets

DUAL FIRING SYSTEM FOR A PERFORATING GUN

TECHNICAL FIELD OF THE INVENTION

The present invention relates in general to hydrocarbon completion and production equipment, and more particularly relates to methods and apparatus for firing a gun for perforating a well casing, or the like.

BACKGROUND OF THE INVENTION

The final stage in the drilling for hydrocarbons and the preparation for production is to lower a casing within the well bore to provide integrity to the subterranean formation. Completion of the oil or gas well is achieved by lowering a perforating gun to the proper location to perforate the casing and allow a hydrocarbon flow from the earth formation into the well bore. There are many well known perforating guns adapted to form holes through the walls of a casing. Such perforating apparatus is generally equipped with high explosive shaped charges which are effective to blast perforations through the casing. After the casing perforation has been completed, the perforating apparatus is either withdrawn or dropped into the well so that production tubing equipment can be used for extracting the hydrocarbon minerals from the cased well bore.

Casing perforating guns are highly developed to improve the efficiency of the perforating operation and to optimize the overall reliability and thus reduce misfiring of the gun. Perforating guns are generally operated in conjunction with firing apparatus fixed hereto to provide safety to personnel. The perforating gun is constructed so that it is triggered only on the successful firing of the firing apparatus. For safety reasons, the gun itself is often first lowered into the well bore to the proper location, and then the firing apparatus is lowered and joined to the gun. The perforating gun and firing apparatus then forms a unit which can be set off to blast perforations through he steel well casing. Alternatively, the firing apparatus and the perforating gun are attached together at the surface and conveyed either by a tubing string or wireline to the proper location in the cased well bore. Such an arrangement is shown in U.S. Pat. Nos. 4,484,639 and 4,770,246 assigned to Dresser Industries, Inc.

In the event of a failure of the firing apparatus or the perforating gun, a substantial amount of time and cost is involved in withdrawing the perforating equipment from the well, complete repair or replacement thereof, and the lower the apparatus back into the proper location of the casing. In certain instances, this can only be accomplished by drilling out various components, such as packers, to retrieve the perforating equipment. It can be appreciated that in drilling and preparing a well for production, the hourly cost may be in the order of $5,000, and thus the malfunction of perforating equipment can have a substantial impact on the overall cost of the operation. In addition, a misfiring or malfunction of the perforating apparatus often damages the equipment to the extent that it is not reusable.

As noted above, the casing perforating apparatus comprises a firing system and a perforating gun, the combination of which is effective to be triggered by an electrical current, fluid pressure or mechanical stimulus to blast holes in the casing. Firing apparatus is generally of rather complex construction, as noted in U.S. Pat. No. 4,484,639, which discloses a detachable firing apparatus and perforating gun. Electrical firing assemblies are generally responsive to an electrical current for setting off the perforating gun, while mechanical firing assemblies are set off by dropping a bar down a tubing string to which the perforating apparatus is connected. Fluid actuated firing assemblies are activated by pressurizing the tubing string or the annulus with a hydraulic fluid or gas.

Because of the ramifications of a failure of firing systems, attempts have been made to improve the reliability by providing dual-type firing systems. In the dual-type firing assemblies, the firing apparatus is duplicated so that if one part should fail, the other can be employed to trigger the perforating gun, without an intermediate tubing string retrieval and repair of the faulty firing mechanism. However, the provision of the dual-type firing system has not only rendered the apparatus more complex and costly, but often the misfiring of one firing assembly renders the other inoperative, generally due to a low-order internal explosion which failed to go high order. U.S. Pat. Nos. 4,632,034 and 4,678,044 each disclose redundant firing apparatus such that if one unit fails, the other can be activated to detonate the perforating gun. However, in the noted duplicated firing assemblies, one must be situated above the perforating gun and the other below, thus necessitating distinct assemblies and additional time, labor, and safety concerns to complete assembly of the unit at the well site.

U.S. Pat. No. 4,610,312 also discloses a redundant firing system which is constructed such that if a primary hydraulic firing head misfires, a secondary mechanical firing head can be activated to set off the perforating gun. However, due to the construction of such a firing head, and especially the arrangement of the detonating cord, it is probable that a low order misfiring of the primary firing equipment could render the secondary firing equipment ineffective to detonate the perforating gun. In addition, the redundant firing systems are not fluid isolated such that any pressurized fluid utilized in firing the hydraulic firing head, if leaked through any of the seal members, can wet the detonating apparatus such that one or both firing heads cannot be activated to detonate the perforating gun. The firing mechanism noted in the patent also requires a differential downhole pressure to activate the hydraulic firing head, which type of activation is susceptible to premature firing, as is well known in the art. Yet another disadvantage of the redundant firing system is that it cannot be retrieved, either by itself or with the perforating gun, from the cased well bore.

From the foregoing, it can be seen that a need exists for an improved dual-type firing system in which both firing assemblies are independent, but yet are housed in a single unit and thus connectable to one end of a perforating gun. A further need exists for a dual-type firing system in which any combination of mechanical and hydraulic firing assemblies can be employed, and in which a misfiring of the hydraulic firing assembly does not allow fluid to affect the firing capability of the other firing assembly. Another need exists for a dual firing system which overcomes the disadvantages of well known firing systems in that there are relatively few moving parts, and conventional hydraulic firing heads can be used as a unit within the firing assembly, thereby simplifying assembly thereof. Another need exists for an assembly in which the firing assembly is releasable from the perforating apparatus while down hole.

SUMMARY OF THE INVENTION

In accordance with the invention, there is disclosed a dual-type firing system and associated apparatus which overcomes the shortcomings and disadvantages of firing systems heretofore known in the art. According to the invention, a high explosive detonating cord has an intermediate section fixed near a bottom portion of the dual firing assembly, adjacent an explosive booster component of a perforating gun situated therebelow. The ends of the high explosive detonating cord are actuable by respective first and second firing assemblies which are encased in the same housing. Explosive acceptors which are attached to the ends of the high explosive detonating cord are sealed from the remainder of the firing system housing, but are actuable by the penetration of corresponding bulkhead membranes as a result of the actuation of the first or second firing assembly. In this manner, the perforating gun is fired by the high explosive detonating cord in response to the detonation of the first or second firing assembly.

In the preferred form of the invention, a hydraulic firing head, which is a readily available unit, is fixed within the firing system housing at a location overlying the bulkhead membrane associated with one end of the U-shaped high explosive detonating cord. Located adjacent the bulkhead membrane at the other end of the high explosive detonating cord is a length of a special mild explosive detonating cord which is connected to a stem cap assembly situated in the housing over the hydraulic firing head. The upper end of the mild explosive detonating cord is terminated with an explosive acceptor in the stem cap assembly which is adjacent another bulkhead membrane which can be punctured in response to the penetration of the associated firing assembly to ignite the high explosive detonating cord, via the mild explosive detonating cord. The bulkhead membrane which forms a top for the stem cap assembly can be penetrated as a result of a mechanical impact, such as by the dropping of a tool bar down the tubing string onto a mechanically actuable head which has a pointed striker adapted to penetrate the bulkhead membrane. In the alternative, a second hydraulic-operated firing head can be fixed within the housing overlying the stem cap assembly so that when actuated in response to a pressurized hydraulic fluid, the bulkhead membrane associated therewith is penetrated.

A dual-type firing system of the type noted can be equipped with two hydraulic firing heads, each responsive to different hydraulic pressures, for selectively activating the desired firing head. In yet another alternative of the embodiment, the dual firing head system of the invention can be equipped with two hydraulic firing heads, each being operative in response to the same hydraulic pressure, wherein both such firing heads are effective to ignite the high explosive detonating cord to assure the reliable firing of the perforating gun. Other combinations of firing heads, including electric firing heads, and slickline-operated firing heads can be utilized with the invention.

In accordance with the invention, the firing assemblies are each isolated from each other, and isolated from the high explosive detonating cord so that any fluid leakage into the system through one firing assembly cannot render the other firing assembly of the system ineffective to set off the perforating gun. With such a construction, either firing assembly can be activated in any order, without predefining a primary or secondary firing order.

According to another feature of the invention, the hydraulic firing head of the dual firing system is responsive to tubing fluid pressures, for activation thereof, without requiring a differential pressure to drive a firing hammer to detonate the perforating gun. The hydraulic firing head, utilized with the dual firing system of the invention, is constructed as a unit which includes an internal spring-loaded striker, the entire unit of which is housed within the system for easy assembly.

Yet another feature of the invention is the provision of disconnect apparatus coupled to the top and/or bottom of the dual firing system which allows retrievability of downhole apparatus by disconnection of part or all of the firing system and the perforating gun. The flexibility of well completion operations is facilitated by enabling the retrieval of the down hole equipment.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts or elements throughout the views, and in which.

DETAILED DESCRIPTION OF THE INVENTION

Figure 1:
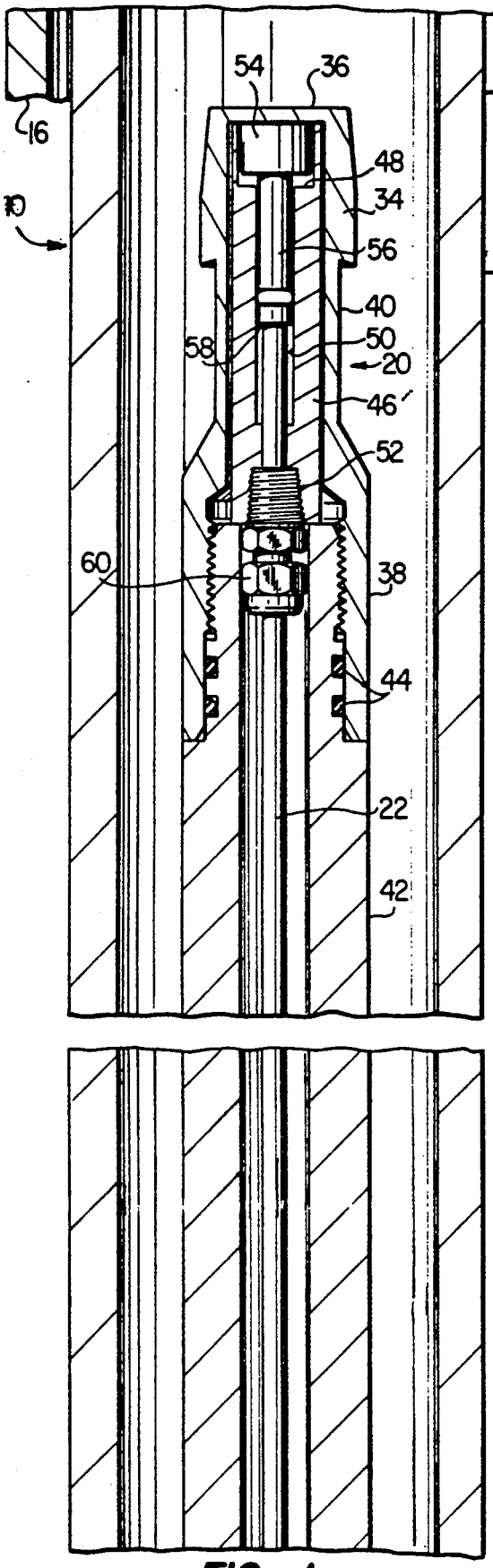
FIGS. 1–3 are cross-sectional views which, when placed together end-to-end, illustrate the dual-type firing assembly according to the invention.

Referring first to FIG. 1 of the drawings, there is illustrated an upper portion of the dual firing system 10 of the invention. The firing system 10 is contained within a tubular housing 12 which can be connected in any conventional manner at its upper end to a tubing string, or other apparatus, and connected at its lower end to a dual fire bushing sub 14. The bushing sub 14 is, in turn, connected to the body of a perforating gun 18. The details of the construction of the lower portion of the firing system will be discussed in detail below.

The firing system 10 is adapted for connection at its upper end so that it can be lowered within a well casing, a portion of which is shown as reference character 16 The well casing 16 generally extends to the bottom of a drilled well and is perforated during the well completion stage by the firing of the perforating gun 18. Different types of perforating guns 18 can be employed with the dual firing system of the invention. A shaped charge type of perforating gun is well suited for use with the invention.

The firing system 10 includes a stem cap assembly 20 defining an upper portion of the assembly 10. The stem cap assembly 20 is connected by a mild explosive detonating cord 22 to one end of a high explosive bidirectional detonating cord 24. The stem cap assembly 20 is constructed to respond to an explosive impact from a mechanical, hydraulic or electric firing head for detonating the mild explosive detonating cord 22 which, in turn, detonates the high explosive detonating cord 24. The high explosive detonating cord 24 has ends 26 and 28 which are activatable by different inputs for firing the perforating gun 18. The detonation of the high explosive detonating cord 24, and especially a curved midsection 30, is effective to trigger the perforating gun 18 explosively to form holes in the casing 16.

The stem cap assembly 20 defines a first input to the firing system 10 for activating the perforating gun 18. An impact generated by a firing head (not shown) is coupled to the upper portion of the stem cap assembly 20, such as that produced by a bar dropped down the housing 12 onto a mechanical firing head attached to the stem cap assembly 20, or by that produced by a hydraulic firing head (not shown) situated atop the stem cap assembly 20. The impact is effective to ignite the explosive capabilities of the mild explosive detonating cord 22. Grapple apparatus having percussion and firing pin assemblies, such as discussed in U.S. Pat. No. 4,770,246, can be latched to or removed from the head of the stem cap 34. Also releasably attachable to an undercut area on the stem cap are electrically activated firing head assemblies. Such assemblies include grapple fingers which are attachable and releasable from the stem cap assembly 20. As noted above, mechanical impact or shock is effective to detonate the stem cap assembly 20.

The firing system 10 further includes an additional input for igniting the high explosive detonating cord 24 to thereby activate the perforating gun 18. In the preferred form of the invention, the second input comprises a hydraulic firing head 32 which is responsive to a hydraulic pressure for igniting the second end 28 of the high explosive detonating cord 24. Hence, by activating either the stem cap assembly 20 or the hydraulic firing head 32, the midsection 30 of the high explosive detonating cord 24 can be explosively ignited to activate the perforating gun 18. Importantly, both inputs for firing the perforating gun 18 are constructed in the same housing and attached only to one end of the perforating gun 18 to provide dual firing capabilities.

In more detail, the stem cap assembly 20 includes a stem cap 34 which is generally hollow, having an upper flat surface defining a stem cap bulkhead membrane 36, and a lower internally threaded portion 38. Formed around an outer surface thereof is an undercut area 40 adapted for latching by a grapple or other firing equipment. Grapple equipment such as that shown in U.S. Pat. No. 4,484,639 can be utilized to attach an auxiliary firing head to the stem cap 34. A wireline or slickline can be used to lower the grapple and auxiliary firing head in the housing 12 for attachment to the stem cap assembly 20. The stem cap 34 is threaded at its bottom end thereof to a tubular stem 42 and sealed thereto by a pair of O-rings 44.

Contained within the stem cap 34 is a stem insert 46 having an upper larger counterbore 48 axially aligned with a smaller lower counterbore 50. The lower end of the stem insert 46 is provided with internal threads 52. The larger counterbore 48 contains an explosive acceptor 54 which is ignited when the stem cap membrane 36 is punctured by an explosive penetrating jet or shock wave, or other mechanical input. In the preferred form, the explosive acceptor 54 is constructed of a lead-azide composition, together with a well known HNS composition. Those skilled in the art may also prefer to fabricate the explosive acceptor 54 entirely of the HNS material or a PYX material. As is well known in the art, the HNS material is sensitive to an explosive shock wave, such as the type which can perforate the stem cap membrane 36, to produce a resultant explosion.

The explosive acceptor 54 is connected to a booster charge 56 housed in an aluminum shell manufactured with a flat bottom to facilitate a larger target area. This also provides a thinner member for the explosive shock wave to detonate the acceptor explosive component material therein. As noted above, the booster charge 56 is exploded in response to the detonation of the acceptor 54. The booster charge 56 is conventionally constructed, using about nine grains of an HMX type of explosive material. Other explosive materials, such as PYX or HNS, or combinations thereof including lead azide may also be utilized. In addition, the aluminum encased booster charge 56 is electrically connected to the stem insert 46 by a conductive grommet 58. The provision of the conductive material between the booster charge 56 and the stem insert 46 prevents electrical static buildup or discharge between the parts and the resulting potential of an inadvertent detonation of the booster charge 56.

The mild explosive detonating cord 22 is also housed within an aluminum or lead azide jacket which is filled with about twenty grains per foot of an explosive material, such as HNS. Importantly, such charge is selected so as not to be destructive to the various components of the firing system 10, but yet transfer the detonation, via other components of the firing system, to the high explosive detonating cord 24. At its upper end, the mild explosive detonating cord 22 is crimped within the aluminum jacket of the booster charge 56. An explosion or detonation generated by the booster charge 56 is thereby transferred to the mild explosive detonating cord 22. The upper end of the mild explosive detonating cord 22 is fixed to the stem insert 46 by a conventional connector retainer 60. The mild explosive detonating cord 22 extends through the retainer 60 and is held in radial compression therein when the retainer 60 is threadably fixed within the threads 52 of the stem insert 46.

The tubular stem 42 provides a protective medium through which the mild explosive detonating cord 22 is routed to apparatus therebelow. The lower end of the tubular stem 42 is threadably fixed within a top junction 62, and sealed thereto by a pair of O-rings 64. The top junction 62 has an internal cavity 66 through which the mild explosive detonating cord 22 is routed into an offset passage 68. The passage 68 is offset from a central axis of the top junction 62 so that the hydraulic firing head 32 can be accommodated within the firing sleeve housing 12 in a side-by-side relationship with the mild explosive detonating cord 22. An upper part of the hydraulic firing head 32 is fixed within another offset passage 72 formed within the bottom of the junction 62.

On the outer surface of the top junction 62 there are provided three fluted grooves 74 axially extending thereàlong, and spaced about 120 degrees apart. The fluted grooves 74 provide a fluid passage between that part of the firing system housing 12 which is above the junction 62, and the hydraulic firing head 32 which is situated below the junction 62. Each fluted groove 74 has a cross-sectional dimension of about $\frac{3}{8}$ inch by $\frac{3}{8}$ inch to provide a sufficient flow rate of fluid to activate the hydraulic firing head 32. The hydraulic firing head 32 includes an upper annularly grooved part 76 for receiving therein the end of a set screw 78 for fixing the hydraulic firing head 32 to the junction 62. The junction 62 provides both centering of the stem cap assembly 20 within the housing 12, as well as for offsetting the mild explosive detonating cord 22 to the side so that the hydraulic firing head 32 can be accommodated within the housing 12.

In the preferred form of the invention, the S hydraulic firing head 32 is of the type described in U.S. Pat. No. 4,770,246, assigned to Dresser Industries, Inc, the disclosure of which is incorporated herein by reference. Such a firing head is activated not by a differential pressure, as is common with other firing heads, but rather is activated either by a tubing fluid pressure or annulus pressure which exceeds a predefined threshold, as input via a fluid port 80. When such a fluid pressure threshold is exceeded, an internal time delay, if provided, is invoked, after which a percussion is generated at the bottom of the hydraulic firing head 32. When activated, a spring in the hydraulic firing head 32 is released and a firing pin is driven into an explosive primer assembly.

The bottom (FIG. 3) of the hydraulic firing head 32 is threadably fixed to the bushing sub 14 and sealed thereto by O-rings 84. As noted in the drawing, an upper end of the bushing sub 14 is constructed with external threads for mating with the internal threads on a bottom end of the firing sleeve housing 12. In addition, the bushing sub 14 is sealed to the firing sleeve housing 12 by a pair of O-rings 86. As will be described in detail below, the O-rings 84 prevent fluid which is introduced into the upper part of the firing sleeve housing 12 to activate the hydraulic firing head 32, from degrading the high explosive detonating cord 24 if the hydraulic firing head 32 fails to detonate.

Figure 2:
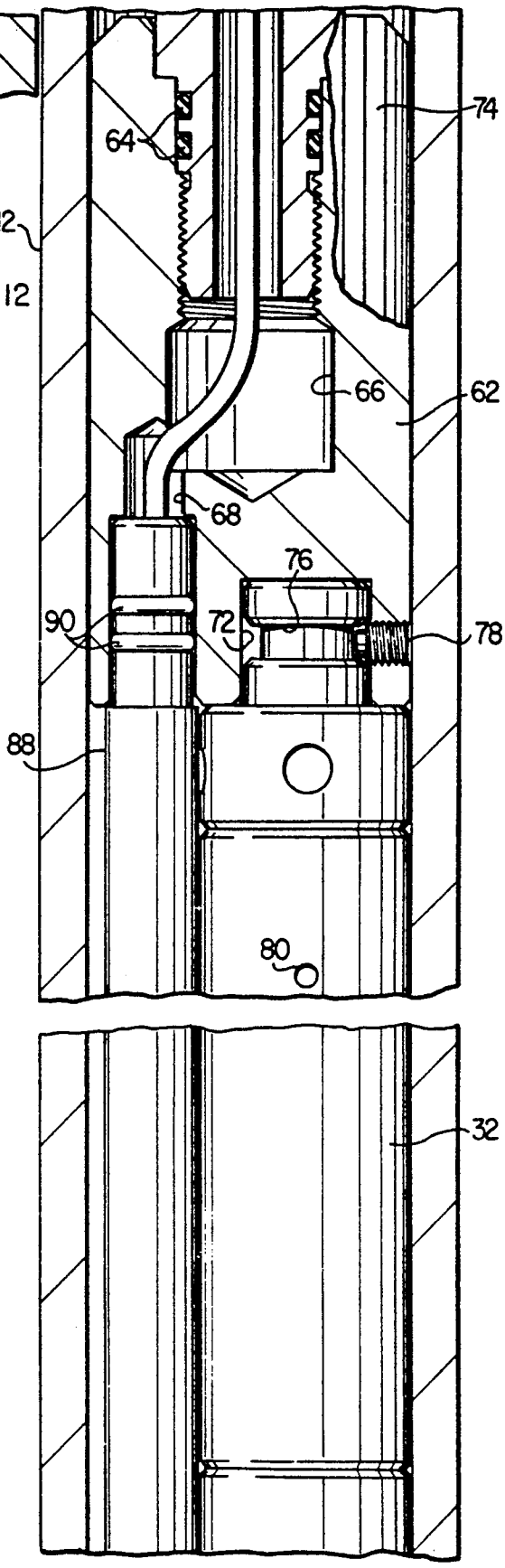

With reference to the left-hand side of the FIG. 2, there is depicted a tubular mild detonating cord housing 88 held between its two longitudinal ends respectively by the top junction 62 and the bushing sub 14. Two pairs of O-rings 90 and 92 effect a seal at both ends of the mild detonating cord housing 88 to the noted support components. The mild explosive detonating cord 22 is routed through the tubular housing 88 for terminating the lower end thereof within the bushing sub 14. As with the lower end of the stem insert 46, the lower end of the tubular detonating cord housing 88 is internally threaded for receiving therein a retainer 94 for fixing the mild explosive detonating cord 22 therein. In addition, the lower end of the mild explosive detonating cord 22 is crimped within a lower booster charge 96 which is held within a cavity 98 by a split sleeve 100. The sleeve is split axially in two pieces to facilitate assembly of the parts. Again, a conductive grommet 102 provides electrical conductivity between the booster charge 96, the split sleeve 100 and the bushing sub 14.

Located within the lower part of the cavity 98 is a donor jet charge 104 which contacts the booster charge 96. The jet charge 104 includes about one gram of a highly explosive material (HNS, or HMX or PYX) which, when discharged, explodes downwardly into the chamber 106. In practice, the get charge 104 is effective to explosively form an opening through a metal barrier, such as identified by a lower bulkhead membrane 108. The bulkhead membrane 108 is about 0.187 inch thick and separates the jet charge chamber 106 from an underlying chamber 110. The bushing sub 14 is preferably constructed of carbon steel of the 4140 type and heat treated, thereby allowing the bulkhead membrane 108 to be penetrated in response to the explosion of the jet charge 104. In like manner, another bulkhead membrane 112 is formed adjacent the percussion sub 82 of the hydraulic firing head 32 and can be penetrated when the firing head 32 is activated.

Figure 3:
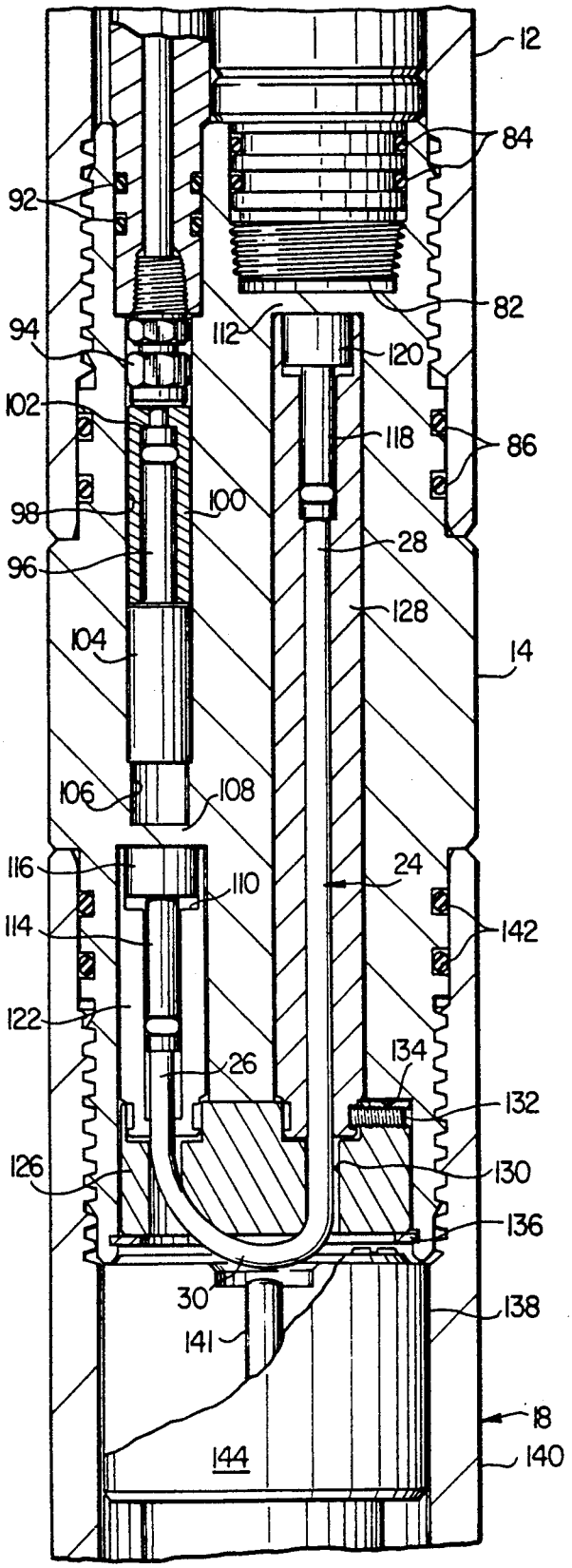

In FIG. 3, the high explosive detonating cord 24 is shown with one end 26 thereof having a booster charge 114 and an explosive acceptor 116. The other end 28 of the high explosive detonating cord 24 is similarly constructed with a booster charge 118 and an explosive acceptor 120. The explosive acceptor 116 is discharged when the bulkhead membrane 108 is penetrated, whereupon the booster charge 114 explodes and with it the end 26 and midsection 30 of the high explosive detonating cord 24. The other end 28 of the high explosive detonating cord 24 operates in a similar manner upon the impact rupturing of the bulkhead membrane 112. The bulkhead membranes 10B and 112 are formed with the noted thickness such that if the activation of either the jet charge 104 or the hydraulic firing head 32 does not go high order, the high explosive detonating cord 24 remains unaffected. Thus if one firing assembly fails, the other is operative to detonate the high explosive detonating cord and thereby set off the perforating gun 18. It should be noted that the bulkhead membranes can be constructed with selected thicknesses to be penetrated on a predetermined concussion level of an explosion or mechanical shock occurring on the top sides thereof.

The explosive acceptor 116 and booster charge 114 associated with end 26 of the high explosive detonating cord 24 are held within split sleeves 122. The split sleeves 122 are constructed in halves along an axial axis thereof and held around the end 26 of the high explosive detonating cord 24. Both halves of the split sleeve 122 are held by grooves at bottom ends thereof by a set screw (not shown) to a slack eliminator 126. The other end of the high explosive detonating cord 24 is held within an elongate sleeve 128 which allows the detonating cord 24 to be routed therethrough from the booster charge 118 through a bore 130 within the slack eliminator 126. The internal bore 130 of the slack eliminator 126 is aligned with a bore within the elongate sleeve 128 so that the high explosive detonating cord 24 can be formed in a U-shape, thereby exposing the intermediate section 30 thereof to the explosive mechanism of the perforating gun 18. The elongate sleeve 128 is fixed at its bottom end thereof to the slack eliminator 126 by a set screw 132. In order to route the high explosive detonating cord 24 in a roundabout manner, the slack eliminator 126 includes one or more angled or curved surfaces for accommodating the curvature formed within the midsection 30 of such detonating cord 24. The slack eliminator 126 is captured within the bottom portion of the bushing sub 14 by a shoulder 134 and a snap ring 136 inserted within an internal annular groove formed within the bushing sub 14.

The singular aspect of the bi-directional high explosive detonating cord 24 enhances the reliability, as both ends thereof, 26 and 28, are integral with the section 30 which provides the actual detonating force to set off the perforating gun. This construction contrasts with the "Y" type of connection described in U.S. Pat. No. 4,610,312 which is the connection of two different detonating cords in an abutting relationship, and crimped together by a metal connector. The concern with the reliability of the "Y" type of connection is apparent.

A pellet holder portion 138 of the perforating gun 18 is fixed with respect to the bottom end of the bushing sub 14 in proximity with the looped intermediate section 30 of the high explosive detonating cord 24 by a body 140 of the perforating gun 18. As can be seen, the slack eliminator 126 routes the high explosive detonating cord so that the intermediate section 30 is disposed adjacent a booster charge 141 associated with the perforating gun 18. The perforating gun body 140 is threadably connected to the bushing sub 14 and sealed thereto by a pair of O-rings 142.

While different types of perforating guns can be employed with the firing assembly of the invention, one such type well adapted for use therewith is identified as a 33/8 OD scalloped type, manufactured by Dresser Industries, Guiberson Division. Such a perforating gun 18 includes a conflagration structure 144 holding therein the booster charge 141 which is positioned proximate the looped section 30 of the high explosive detonating cord 24. When the detonating cord section 30 explodes, the percussion thereof is effective to detonate the perforating gun booster 141 and thereby activate the perforating gun 18 and explosively form holes or perforations within the casing 16 as well as any cement which may be utilized in fixing the casing 16 to the well bore.

Having described the construction of the invention, the operation thereof will next be detailed. After assembly of the firing system 10 and the attachment of the perforating gun 18 thereto, the unit is attached to coupled tubing sections and lowered into the casing 16 to the depth at which it is desired to form perforations. If it is desired to fire the perforating gun 18 by pressurizing the firing sleeve housing 12 with a fluid, such a fluid is pumped down the housing 12 to the desired pressure, whereupon the hydraulic firing head 32 is activated. Packers or other equipment can be utilized for controlling and directing the pressurized fluid to the hydraulic firing head 32. The activation of the hydraulic firing head 32 results in the explosion of a bottom part 82 of the firing head 32, thereby penetrating the bulkhead membrane 112. When the membrane 112 is broken, the explosive acceptor 120 is ignited, as well as the booster 118 and the high explosive detonating cord 24. Once the midsection 30 of the high explosive detonating cord 24 ignites, the booster 141 within the perforating gun 18 ignites as well, thereby perforating the casing 16 with shaped charges (not shown). Should the hydraulic firing head 32 fail to become activated in response to fluid pressure within the firing sleeve housing 12, such fluid does not contaminate the high explosive detonating cord 24, as the bulkhead membranes 108 and 112 remain intact. In accordance with an important feature of the invention, the high explosive detonating cord 24 can be ignited by alternative means, such as by firing head apparatus connected to the stem cap assembly 20.

The stem cap assembly 20 can be activated mechanically by dropping a bar down the tubing, through a narrowed restricter area, and through the firing sleeve housing 12 to impact a mechanical percussion firing head fixed to the stem cap 34. The upper end of the firing sleeve housing 12 can be fixed or fastened to a restriction sub which has a reduced internal diameter for aligning a rod dropped within the housing and directing it onto the mechanical percussion firing head attached to the stem cap 34. The mechanical load is effective to detonate the percussion firing head to ignite the explosive acceptor 54, the booster charge 56 and the mild explosive detonating cord 22. The mild explosive detonating cord 22, in turn, ignites the booster charge 96 and the get charge 104. The high explosive nature of the get charge 104 is effective to break the bulkhead membrane 108 and ignite the explosive acceptor 116, the booster charge 114 and the high explosive detonating cord 24. Again, the detonation of the high explosive detonating cord 24 is effective to set off the booster charge 141, via the intermediate cord section 30, and thus the perforating gun 18 to form the perforations within the casing 16. Should the firing apparatus on the left side of the figures be activated first and fail, for whatever reason, the bulkhead membrane 108 will remain intact, thereby leaving the high explosive detonating cord 24 intact and ready for detonating by the activation of the firing apparatus on the right side of the figures.

As can be appreciated, the hydraulic firing head 32 can be considered as the primary source for firing the perforating gun 18, with the stem cap assembly 20 and associated firing head assembly being the backup or secondary firing mechanism. In like manner, the stem cap firing head assembly 20 can be considered as the primary means for firing the perforating gun 18, with the hydraulic firing head 32 as the backup. Neither the primary nor the backup firing status of the assemblies need be determined beforehand, but rather can be decided upon after the firing system 10 and perforating gun 18 have been lowered into the casing to the proper location.

When the stem cap firing head assembly 20 is determined to be the primary firing mechanism for the perforating gun 18, a malfunction thereof can result in a low order burn of the mild explosive detonating cord 22, rather than a desired high order explosion. However, because the mild explosive detonating cord 22 is constructed with a mild charge, it does not destroy the other components of the firing system 10, as such cord 22 is provided with adequate metal or steel protective components therearound. In the event of a malfunction of the detonation of the stem cap firing head assembly 20, fluid can be pumped down the firing sleeve housing 12 to activate the hydraulic firing head 32. Advantageously, the bi-directional high explosive detonating cord 24 is provided with two ends in a single enclosure, each of which can be detonated by the noted respective firing means which are also fabricated as a single unit.

Figure 4:
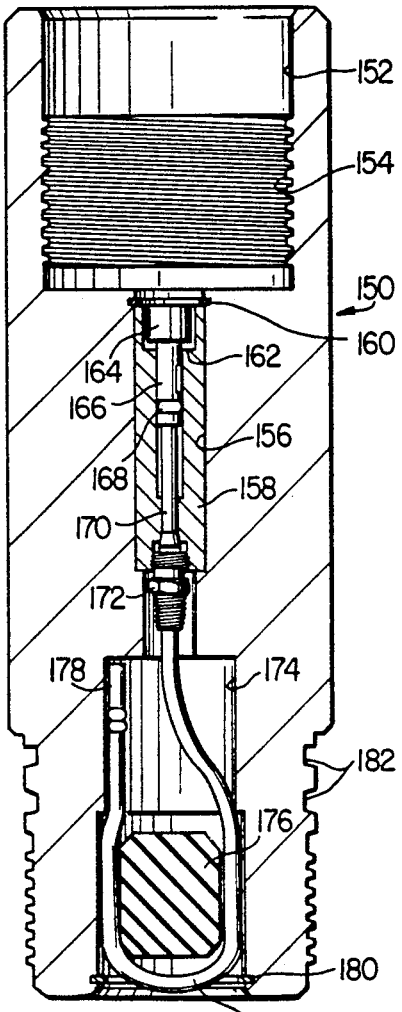
FIG. 4 is a sectional view of a crossover sub which can be employed with the dual firing assembly of the invention.

While the perforating gun 18 is shown connected directly to the bushing sub 14, there may be instances in which such a connection is not desirable, or is not feasible. In such event, and as shown in FIG. 4, a crossover sub 150 is shown for connecting the bottom portion of the bushing sub 14 to a firing gun 18. The crossover sub 150 has an internal bore 1S2 for sealing, via O-rings 142, to the bottom portion of the bushing sub 14. An internally threaded area 154 of the crossover sub 150 is mateable with the external threads on the bottom part of the bushing sub 14. A central axial bore 156 in the crossover sub 150 is adapted for receiving a stem insert 158 which is captured below a bottom shouldered part of the bore 156 and an upper expandable retainer ring 160.

The insert 158 includes a larger diameter bore 162 for receiving an explosive acceptor charge 164 which is connected to a booster charge 166. The booster charge 166 is crimped by grommets 168 to a detonating cord 170 having a desired number of explosive grains per foot. The detonating cord 170 is held by a retainer 172 within a lower threaded part of the insert 158. The lower portion of the detonating cord 170 is routed through a chamber 174 around a wrap-around block 176 and returned back to the chamber 174. The end of the detonating cord 170 is terminated with an end cap acceptor 178.

The wrap-around block 176 and an intermediate section of the detonating cord 170 are contained at the bottom of the crossover sub 150 by an expandable retainer ring 180. A central opening within the retainer ring 180 allows for a slight protruding therefrom of the detonating cord 170. In this manner, a perforating gun can be threadably fixed to the externally threaded portion of the crossover sub 150 and sealed thereto by O-rings (not shown) which are assembled in the respective grooves 182. Apparatus of similar construction is shown in U.S. Pat. No. 4,650,009, assigned to Dresser Industries, Inc., the disclosure of which is incorporated herein by reference.

The construction of the crossover sub 150 allows it to be easily interfaced between the dual firing system 10 described above and a percussion reactive firing gun. When so assembled, the detonation of the intermediate section 30 of the high explosive detonating cord 24 is effective to ignite the explosive acceptor 164 of the crossover sub 150. The ignition of the acceptor 164 ignites the booster charge 166 which, in turn, ignites the highly explosive detonating cord 170. When an intermediate section 184 of the detonating cord 170 explodes, a booster charge associated with the perforating gun is exploded, thereby setting off the perforating gun.

Figure 5:
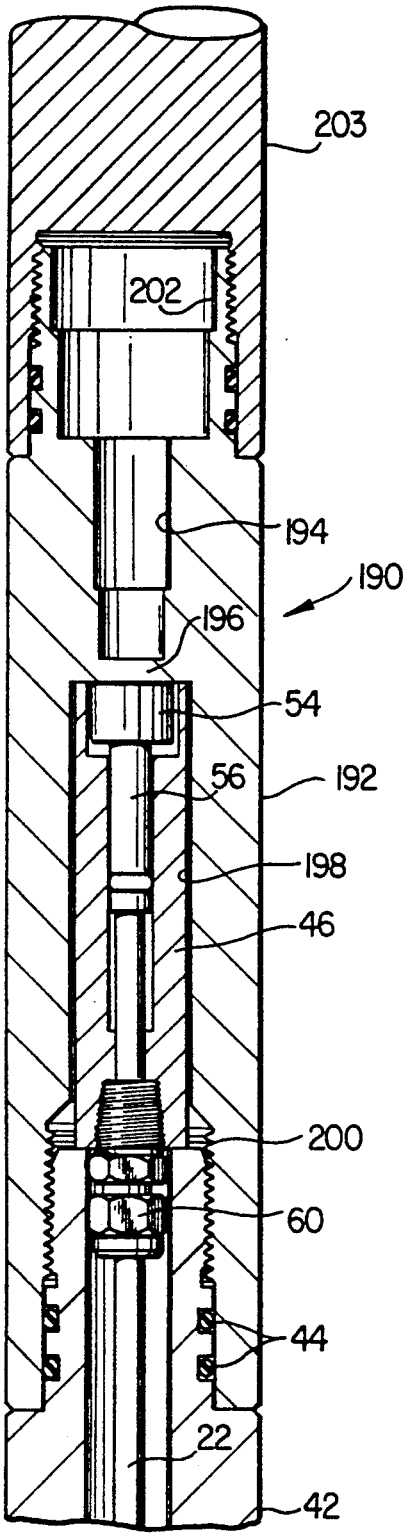
FIG. 5 is a sectional view of a non-retrievable firing head which is hydraulically operated.

Should it be desired to employ a pair of hydraulic firing heads, a hydraulic firing head mating assembly 190 can be installed on the threaded part of the stem 42, rather than the stem cap 38. A hydraulic firing head mating assembly suitable for use with the invention is show in FIG. 5. Such a mating assembly 190 includes a hydraulic percussion sub 192 having an upper percussion chamber 194 separated by a bulkhead membrane 196 from a lower bore 198. The lower bore 198 receives therein the stem insert assembly 46 of the firing system 10. The stem insert assembly 46 is fixed within the bore 198 via threads 200 and seals 44. The percussion end of a hydraulic firing head 203, similar to that shown above as hydraulic firing head 32, can be threadably fixed to the hydraulic percussion sub 190 so an explosive portion thereof fits within the cavity 202. When equipped with such a percussion sub 190, an upper hydraulic firing tool 203 is not retrievable.

Each of the noted hydraulic firing heads can be preset to be activated in response to different pressures, or can be both activated at the same hydraulic pressure. Primary and secondary firing mechanisms are available by providing either of the hydraulic firing heads with a mechanism which is activatable at a first hydraulic pressure, and providing the other hydraulic firing head with a mechanism which is activatable at a higher hydraulic pressure. On pressurizing the firing sleeve housing 12 to the lower hydraulic pressure, one of the hydraulic firing heads will be activated, but if a malfunction occurs, the housing 12 can be pressured up to a higher hydraulic pressure to thereby activate the backup firing head.

Figure 6:
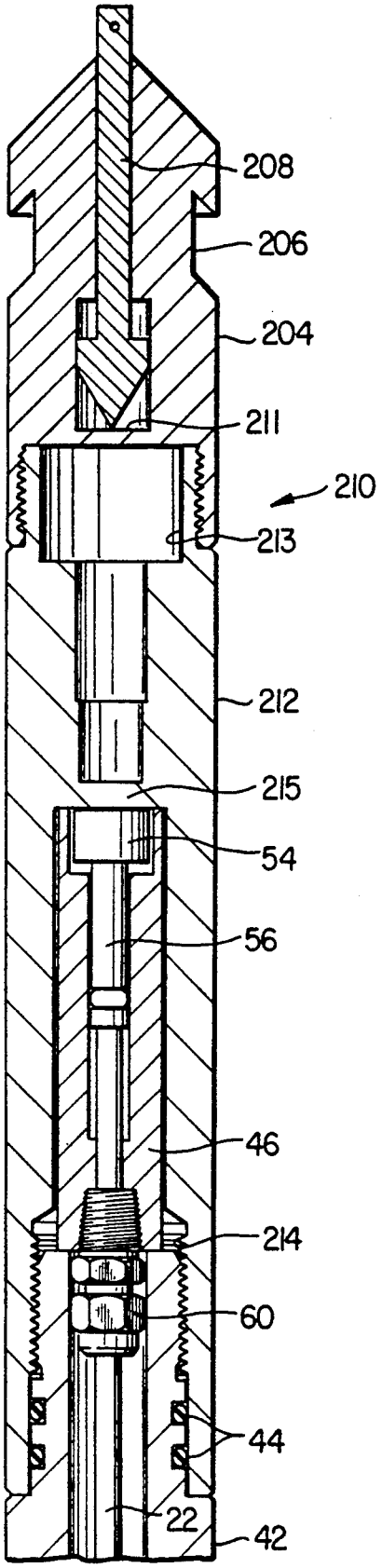
FIG. 6 is a sectional view of a non-retrievable firing head which is mechanically operated.

FIG. 6 illustrates a non-retrievable mechanical percussion sub 210. The mechanical sub 210 is similar in construction to the hydraulic percussion sub 190. A mechanical firing head 204 is threadably fixed to an upper part of the mechanical sub 210. The mechanical firing head 204 includes an annular notched section 206 to which a grapple assembly can be releasably mounted. A pointed pin 208 is mounted within the sub 204 so as to be rammed into a barrier 211 for penetration thereof. Housed within a cavity 213 are explosive charges (not shown) which are set off by the penetration of the barrier 211 by the pin 208. The detonation of the explosive charge is, in turn, effective to cause a shock wave to penetrate the bulkhead membrane 215 and detonate the explosive acceptor 54. The firing assembly of the invention is thus set into action, as described above.

The housing 212 includes internal threads 214 mateable with the external threads of the firing assembly stem 42. Seals 44 are effective to seal the mechanical percussion sub 210 to the firing system 10.

Figure 7:
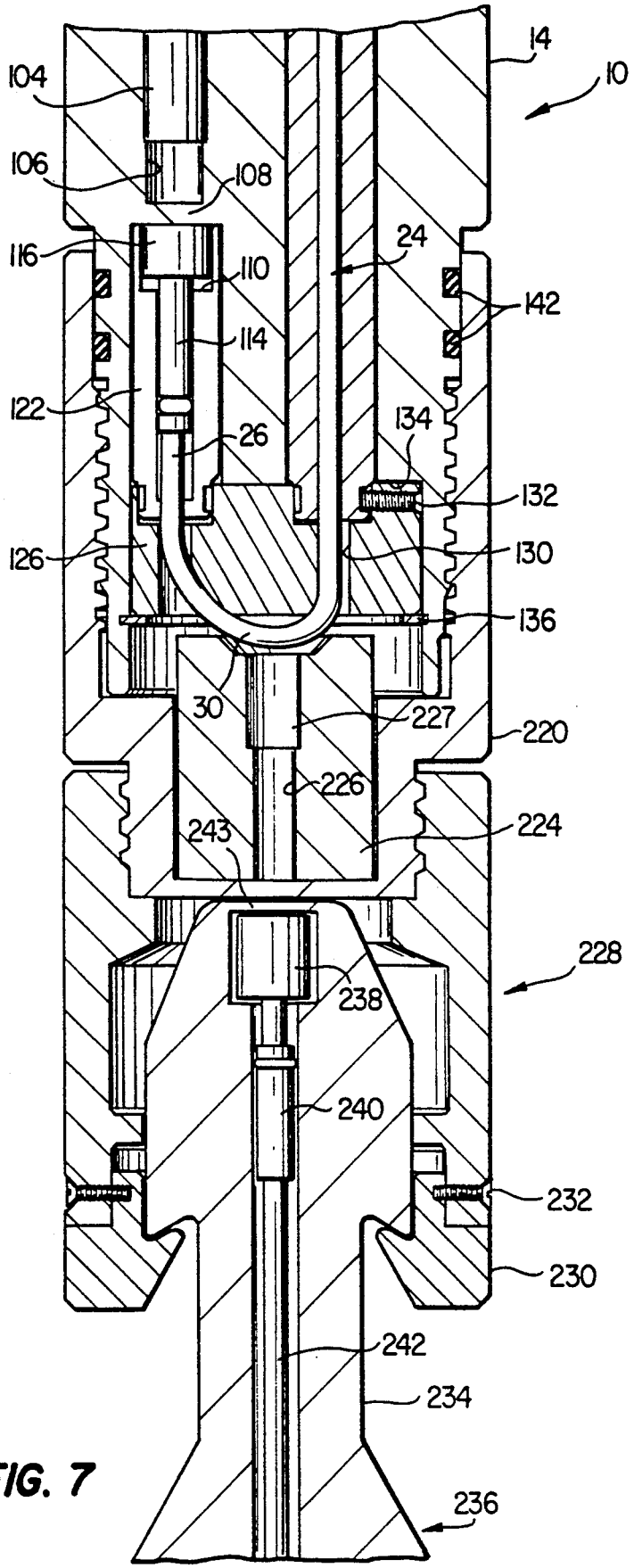
FIG. 7 is a sectional view of a lower portion of the dual firing system of the invention releasably attached to perforating gun apparatus.

FIG. 7 illustrates a technique for releasably connecting the dual firing system 10 of the invention to perforating gun apparatus. Such a structure is highly advantageous in situations where it is desired to remove the firing apparatus from a borehole without also removing the perforating apparatus. According to this feature of the invention, a percussion firing sub 220 is threadably fastened to the bushing sub 14. A slack adjuster 224 is held within the firing sub 220 for securing the bottom or intermediate section 30 of the high explosive detonating cord 24. The slack adjuster 224 includes a central cavity 226 for carrying the detonation shock wave generated by a get charge 227 to the perforating apparatus connected therebelow.

On a lower threaded part of the percussion firing sub 220 is connected a grapple assembly 228, much like that described in U.S. Pat. No. 4,269,009. The grapple assembly 228 has hooked fingers 230 fixed to the assembly by shear screws 232. The hooked fingers 230 are operative for latching to an undercut area 234 of the stem cap 236 which, in turn, is connected to a perforating gun (not shown). Similar in construction to that described above, the stem cap 236 includes an explosive acceptor 238 and associated booster charge 240 and high explosive detonating cord 242. The explosive acceptor is set off by the shock wave generated by the get charge 227 which penetrates the bulkhead membrane 243.

The perforating apparatus can be located in the casing by conventional techniques with the firing system attached thereto via the grapple apparatus. The perforating apparatus can then be set or fixed to the casing by slips or packers. Should it be desired to remove the firing apparatus from the perforating apparatus, it is only necessary to pull on the firing system, whereby the finger screws 232 are sheared and the firing apparatus is released form the perforating apparatus.

From the foregoing, disclosed is a perforating gun firing assembly which is a compact true dual-type system in which one firing head thereof can be reliably activated in the event the other malfunctions. A technical advantage of the invention is that the components of the firing system are protected sufficiently such that an undesirable low order firing of the detonating components, which may lead to faulty operation thereof, does not destroy the components required to activate and detonate the alternative firing apparatus. An important technical advantage of the invention is that a high order detonating cord is sealed in a chamber, with its two ends adapted for detonating by the first and second firing heads. An intermediate section of the high explosive detonating cord is located proximate detonating components of the perforating gun so that either of the activated firing equipment is effective to trigger the perforating gun. An important technical advantage of the dual firing system of the invention is that both firing heads are constructed as a single unit to which one end of a perforating gun is attached.

While the preferred and other embodiments of the invention have been disclosed with reference to specific firing systems and methods of operation thereof, it is to be understood that many changes in detail may be made as a matter of engineering choices without departing from the spirit and scope of the invention, as defined b the appended claims.

What is claimed is:

1. A dual firing system for use with detonation perforating apparatus in a well completion operation, comprising:

an elongate detonator having two ends each fireable by a different source;

a first firing apparatus adapted for activating said detonator in response to a first input thereto;

a second firing apparatus adapted for activating said detonator for firing said perforating apparatus in the event said first firing apparatus fails such that a dual firing of said perforating apparatus is permitted;

a housing for containing said first and second firing apparatus and said detonator as a unit attachable with resect to one end of the perforating apparatus; and a chamber in said housing for containing said elongate detonator in fluid isolation from said first and second firing apparatus, said chamber having two bulkhead membrane sidewall areas each adjacent a respective said detonator end, said bulkhead membranes being adapted for penetration for setting off said detonator.

2. The dual firing system of claim 1, wherein said first firing apparatus is fluid activated and said second firing apparatus is adapted for firing by one of various firing mediums.

3. The dual firing system of claim 1, wherein said detonator comprises a detonating cord contained within said housing, and having ends for firing respectively by said first and second firing apparatus, and an intermediate section responsive to detonation of at least one end thereof for activating said perforating apparatus.

4. The dual firing system of claim 3, wherein said chamber is said housing is adapted for containing said detonating cord so that if one said firing apparatus fails, said cord is not contaminated and prevented from being fired by said other firing apparatus.

5. The dual firing system of claim 4, wherein each said bulkhead membrane seals said chamber.

6. The dual firing system of claim 5, wherein said chamber is elongate and said bulkhead membranes are located at ends of said chamber.

7. A method for firing a dual system for reliably detonating perforating apparatus, comprising the steps of:

pressurizing a housing containing the dual firing system to a first pressure to detonate a first firing assembly;

penetrating a membrane in response to the firing of a first firing head of said first firing assembly to thereby detonate high explosive detonating apparatus if said first firing assembly goes high order;

activating a second firing assembly if said first firing assembly fails; and penetrating a second membrane if said second firing assembly goes high order such that said high explosive detonating apparatus is detonated to activate said perforating apparatus.

8. The dual firing system of claim 3, wherein said detonation cord is a singular construction, disposed in a U-shape with ends thereof being actuable, and with said intermediate section adjacent a detonator of said perforating apparatus.

9. The dual firing system of claim 1, wherein said housing is tubular and including an upper end connectable to a tubing string, and a lower end adapted for connection to the perforating apparatus.

10. A dual firing system for use in detonating perforating apparatus in a well completion operation, comprising:

a first firing assembly responsive to mechanical input energy for generating a detonation;

a mild detonating cord connected to said first firing assembly and capable of being detonated thereby, one end of said mild detonating cord being adjacent a membrane which is penetrated in response to detonation of said mold detonating cord;

a second firing assembly terminating adjacent a second membrane which is penetrated on detonation of said second firing apparatus; and a high explosive detonating cord having ends adjacent different said membranes, and an intermediate section thereof adapted for detonating said perforating apparatus.

11. The dual firing system of claim 10, further including a sealed chamber for routing said mild detonating cord from said first firing assembly to an associated said membrane, said sealed chamber being operative to provide a fluid seal between said high explosive and mild detonating cords.

12. The dual firing system of claim 11, wherein said chamber is constructed of rigid side walls so as to withstand a detonation of said mild detonating cord.

13. The dual firing system of claim 12, further including a housing for containing said dual firing system, said housing being adapted for fluid pressurization, and wherein said mild detonating cord chamber is insulated from pressurized fluid within said housing.

14. The dual firing system of claim 13, wherein said housing is adapted for connection to one end to a tubing string and at another end to said perforating apparatus.

15. The dual firing system of claim 11, wherein said high explosive detonating cord is contained within a chamber which is fluid isolated from said first and second firing assemblies.

16. The dual firing system of claim 10, wherein said high explosive detonating cord is a single U-shaped cord, with an intermediate section thereof adjacent a detonator of said perforating apparatus.

17. A dual firing system for use in detonating perforating apparatus in a well completion operation, comprising:

a stem cap assembly including a thin membrane overlying an acceptor charge, said acceptor charge being adjacent a booster charge one end of which is connected to a mild detonating cord;

a rigid stem connected to said stem cap assembly, and having a bore therein for carrying said mild detonating cord;

a junction secured to said stem and having a bore and an offset portion for routing said mild detonating cord in an offset manner;

a detonating cord housing sealed to said junction for carrying said detonating cord in said offset manner;

a hydraulic firing head having a fluid input responsive to a predetermined fluid pressure, and being secured to said junction adjacent said mild detonating cord;

a bushing sub having a first input and a second input for supporting in a sealing manner respectively said detonating cord housing and said hydraulic firing head;

an explosive assembly connected to a lower end of said mild detonating cord;

a high explosive detonating cord with a first and second end; and a pair of membranes formed in said bushing sub adjacent ends of said high explosive detonating cord, one said membrane being adjacent an explosive end of said hydraulic firing head, and another said membrane being adjacent a detonating assembly on a lower end of said mild detonating cord, an intermediate section of said high explosive detonating cord being adjacent a detonator for activating said perforating apparatus.

18. The dual firing system of claim 17, further including means on said stem cap assembly for releasably gripping said dual firing system for attachment to other firing apparatus.

19. The dual firing system of claim 17, further including an acceptor assembly and a booster charge associated with each end of said high explosive detonating cord.

20. The method of claim 7, further including sealing said high explosive detonating apparatus from pressurized fluid utilized for firing one said firing assembly.

21. The method of claim 7, further including arranging said high explosive detonating apparatus as a single detonating cord extended between said first and second membranes.

22. The dual firing system of claim 1, wherein said detonator comprises a detonator cord having at each end thereof an explosive acceptor adjacent a respective said bulkhead membrane.

23. The dual firing system of claim 22, wherein each said explosive acceptor is connected to said detonator cord by a booster charge.

24. The dual firing system of claim 22, wherein each said bulkhead membrane has one said explosive acceptor on one side thereof, and a donor jet charge on an opposing side thereof.

25. The dual firing system of claim 24, wherein said donor jet charge is connected to one said firing assembly by an explosive cord.

26. The dual firing system of claim 25, wherein said explosive cord is of a mild type which, when exploded, does not substantially damage said dual firing system.

* * * * *

UNITED STATES PATENT AND TRADEMARK OFFICE

CERTIFICATE OF CORRECTION

PATENT NO. : 5,007,344

DATED : April 16, 1991

INVENTOR(S) : Thomas D. Ricles et al.

It is certified that error appears in the above-identified patent and that said Letters Patent is hereby corrected as shown below:

Col. 7, line 9, delete "S".

Col. 7, line 62, change "get" to --jet--.

Col. 10, line 2, change "get" to --jet--.

Col. 10, line 3, change "get" to --jet--.

Col. 12, line 25, change "get" to --jet--.

Col. 12, line 38, change "get" to --jet--.

Col. 13, line 8, change "b" to --by--.

Col. 14, line 2, change "is a" to --is of--.

Col. 14, line 19, change "mold" to --mild--.

Signed and Sealed this

Twenty-seventh Day of October, 1992

*Attest:*

DOUGLAS B. COMER

*Attesting Officer*

*Acting Commissioner of Patents and Trademarks*